United States Patent [19]

Gioello

[11] 4,293,959

[45] Oct. 13, 1981

[54] STRETCH KNIT BODY SUIT WITH PADDED AREAS

[76] Inventor: Debbie A. Gioello, 237 Van Cortlandt Park Ave., Yonkers, N.Y. 10705

[21] Appl. No.: 106,496

[22] Filed: Dec. 26, 1979

[51] Int. Cl.[3] ..... A41B 17/02; D06C 14/00; A41H 1/00

[52] U.S. Cl. ..... 2/243 B; 223/66; 33/17 R

[58] Field of Search ..... 2/243 R, 243 B, 2.1 R; 223/66, 67, 68; 33/17, 15, 12

[56] References Cited

U.S. PATENT DOCUMENTS

| | | | |
|---|---|---|---|
| 385,637 | 7/1888 | Ledoux | 33/17 R |
| 1,380,418 | 6/1921 | Rosuall | 33/15 |
| 3,246,337 | 4/1966 | Copeland | 2/2.1 R |
| 3,609,766 | 10/1971 | Olive | 2/243 B |
| 3,907,107 | 9/1975 | Vercollone | 223/68 |

*Primary Examiner*—Doris L. Troutman
*Attorney, Agent, or Firm*—Charles E. Temko

[57] ABSTRACT

A means and method for designing and fabricating garments, particularly suited for the home sewer. Using a stretch body suit having cushioned areas, muslin panels are draped on the individual wearing the suit to conform to the individual shapes and contours. The muslin panels form a basic pattern which include front and back portions of a bodice, a basic fitted skirt, and basic pants. The pattern is used to provide a corresponding plurality of oak tag slopers which may be manipulated to provide a variety of designs relative to the individual slopers. These slopers, manipulated into new designs, are used to make paper patterns which are in turn used as a guide in cutting actual garment sections which are stitched together to provide a completed garment which fits the individual with little or no alteration.

2 Claims, 4 Drawing Figures

STRETCH KNIT BODY SUIT WITH PADDED AREAS

BACKGROUND OF THE INVENTION

This invention relates generally to the field of garment design and fabrication on a custom basis, and more particularly to an improved means and method therefore particularly suited for use by the non-commercial or home sewer to facilitate the design and fabrication of personally created garments.

In the field of women's clothing, the search for individuality is never ending. The desire for custom styling is no less prevalent in the case of the home sewer than in those who are fortunate enough to afford the luxury of professional clothiers.

Much progress has already been made in the art. It is known, for example, to provide dress forms which have been contoured to correspond, but never actually duplicate all the contours and measurements of any one individual figure, which the individual sewer may employ in cutting and fitting of the individual sections which comprise a garment, the muslin panels, or garment sections, being pinned in place so that the lines of interconnection by sewing may be determined. The sections are then removed from the form, and sewn together to result in a garment which exactly fits the user.

The use of such forms, however, presupposes that the sewer is skilled in draping fabrics to desired shapes and contours, prior to pinning to the form, a skill possessed by relatively few home sewers. As a result, the bulk of home sewers rely upon pattern catalogues for selection, and preprinted paper patterns which must be altered from original form for custom fitting, and which do not afford the opportunity of subsequent redesign.

SUMMARY OF THE INVENTION

Briefly stated, the invention contemplates the provision of a perfected muslin pattern which exactly conforms to an individual which is obtained by draping muslin panels upon a stretch body suit having cushioned areas which are used for pinning the muslin panels and subsequently the patterns which normally include front and back bodice sections, a basic fitted skirt, basic fitted sleeves, and basic pants. The pieces of this pattern may be sewn together to assure accuracy by test fit, and then separated to permit the making of a plurality of oak tag "slopers," corresponding to each panel element. The slopers are subsequently manipulated to produce individual designs. Thus, there may be conveniently provided for each component six or more variations, each of which is combined with selected variations of other sections to make a composite design created by the sewer herself. The slopers in turn are used to create paper patterns which form the outlines for cutting fabric panels in turn assembled into garments. Since the variations in the slopers do not alter basic dimensions in the muslin patterns, very little if any fitting and adjustment is necessary.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
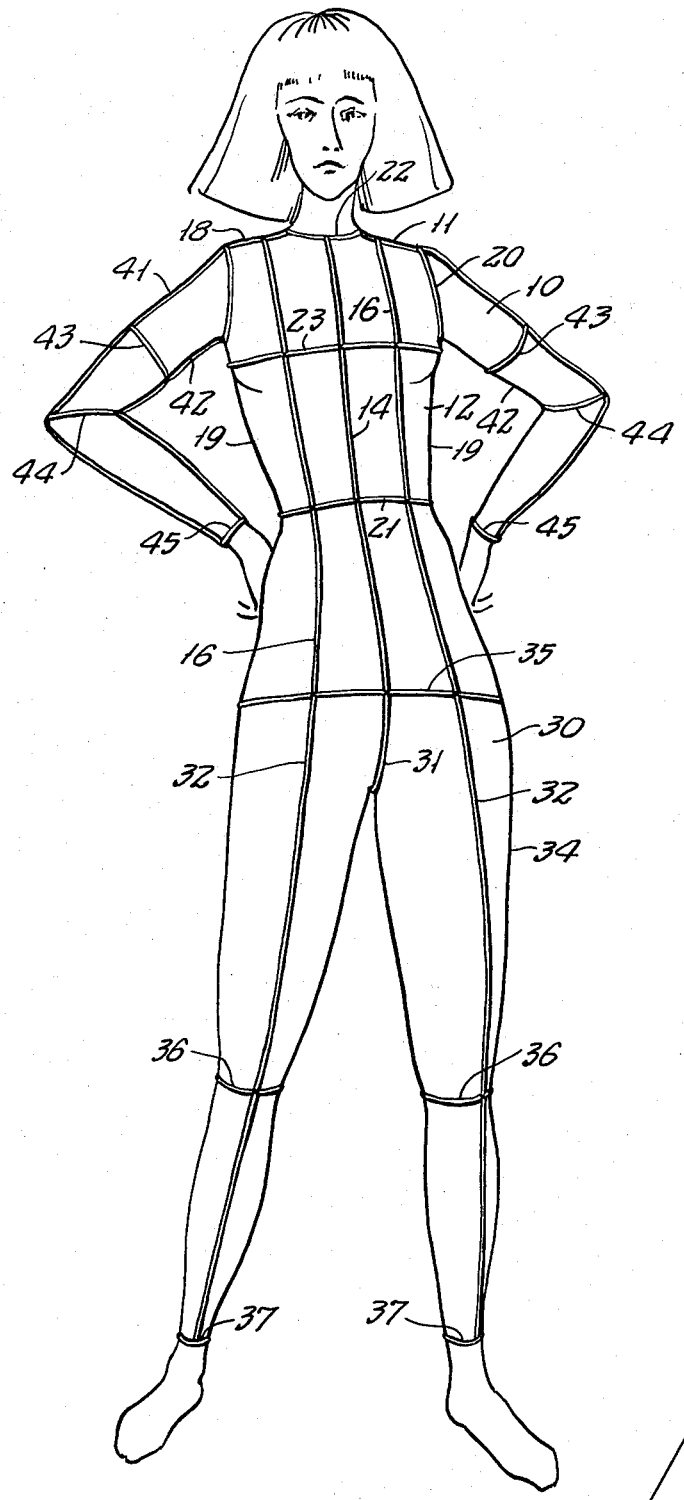
FIG. 1 is a front elevational view of a stretch body suit, in position upon a wearer prior to the fitting and attachment of a plurality of panels used to form a basic body pattern.
Figure 2:
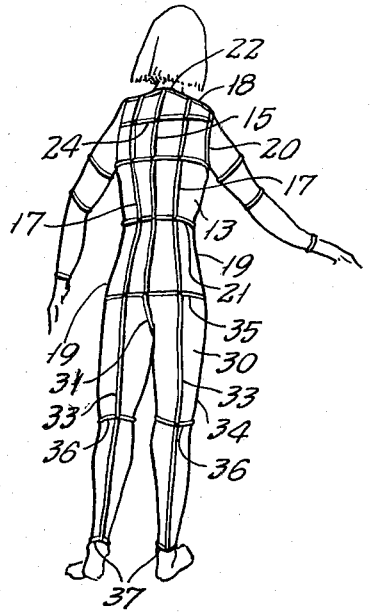
FIG. 2 is a rear elevational view thereof.

In accordance with the invention, and with reference to FIG. 1 in the drawing, there is first provided a stretch body suit of knitted type, similar to those worn by ballet dancers. The suit, generally indicated by reference character 10, is provided with a plurality of elongated padded areas 11 which serve to delineate individual muslin panels which will be pinned thereto to form the perfected pattern. A front bodice section 12 and rear bodice section 13 are thus provided with padded areas 11 which will determine peripheral edges of the muslin panels, which are pinned thereto, so that lines of stitched interconnection may be marked prior to their removal, and the sewing of the panels together to form the perfected muslin pattern. As seen in FIGS. 1 and 2, these areas include center front 14, center back 15, princessline front 16, princessline back 17, shoulder seams 18, side seams 19, armscyes 20, waistline 21, neckline 22, bust level 23 (across the apex area) and an area interconnecting the back shoulder from armscye to armscye and designated by reference character 24.

The lower torso portion of the stretch suit, generally indicated by reference character 30, is provided with similar padded areas. These include one around the crotch line at the center, designated by reference character 31, princessline front 32, princessline back 33, side seams 34, hip level 35, knee level 36 and ankle level 37.

The sleeve members 40 include an upper arm seam (or center grainline of sleeve) 41, underarm 42, bicep level 43, elbow level 44, and wrist level 45.

Once donned by the sewer, another person accurately fits the corresponding panels with the peripheries pinned to the padded areas by the simple expedient of cutting, shaping and fitting the perimeter of the pattern pieces which correspond to the neck, shoulder, armscye, side, waist, center back, center front, etc. of the body, including dart pick-up, which are marked and trued. Additional fabric is provided at the periphery to permit sewing of the panels together, and when all of the panels have been pinned and fitted to conform to the body therebeneath, the lines of interconnection are correspondingly established. Upon completion of all of the panels, which are shaped into pattern sections, they are unpinned from the body suit and sewn together, following which they may be tried by the wearer. Since the muslin panels are normally not stretchable, all of the seams are not interconnected at the final try. Once correct dimensions are established, the muslin pattern is made into a tool referred to as a sloper, the contours of which may be varied during the designing process. The slopers may be provided with one or more darts, as is known in the art.

Figure 3:
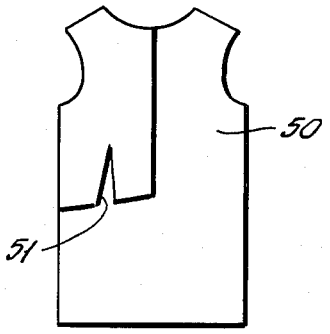
FIG. 3 is a developed view of a front bodice section forming a part of a basic pattern.
Figure 4:
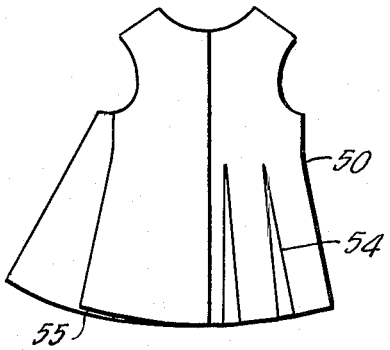
FIG. 4 is a developed view of a section bodice section thereof.

Referring to FIGS. 3 and 4, reference character 50 designates a bodice oak tag sloper of so-called one dart type, including a dart 51 which is shown in FIG. 3 in unshifted position. By transposing and turning certain parts of the sloper with respect to the remaining parts, different contours for a given panel are obtained, while maintaining essentially the critical peripheral dimensions which were determined from the perfected muslin pattern.

FIG. 4 shows a tent-shaped bodice, obtained by providing a plurality of cuts 54 which may be spread to provide an enlarged lower edge 55 and used to prepare a further paper pattern (not shown) in which the lower peripheral edge is continuous. It is the final draft which is used to prepare a paper pattern, or the same may be used directly upon textile material to form a dress pattern.

It will be observed that the forming of the perfected muslin pattern may be conveniently performed as a service by a commercial retail outlet, and upon being supplied with the individual components of the perfected muslin pattern, the home sewer is in a position to make and alter her own slopers at home in the course of designing an individual garment. From the slopers, she can create her own paper patterns, and, if desired, combine those with others she has previously made to provide a stock of individual garment components of different configurations which may be combined for novel creations. For example, using only six basic slopers, if the sewer provides six variations of each of these six components, she has 36 patterns which can be combined to provide as many as 720 individual garment designs.

I wish it to be understood that I do not consider the invention limited to the precise details of structure shown and set forth in this specification, for obvious modifications will occur to those skilled in the art to which the invention pertains.

I claim:

1. As a new article of manufacture, a stretch body suit used for the forming of a precision garment pattern corresponding to the figure of a wearer, said suit consisting substantially of knitted material and having a plurality of elongated padded areas on the outer surface thereof, said padded areas being stretchable along the principal axis thereof with said body suit, said padded areas being adapted to receive pins for retaining panels in position upon the suit while worn, while shielding the wearer from penetration of said pins; said padded areas defining a plurality of horizontally disposed lines encircling the wearer at the neck, shoulders, bust, waist, hips, knees, ankles, biceps, elbows and wrists; said padded areas defining a plurality of vertical lines at the armscyes, center front, center back, and sides of the torso, and the inner and outer sides of the arms and legs of said bodysuit.

2. A stretch body suit in accordance with claim 1, further characterized in the provision of additional elongated pads at the front and back princess lines of the suit.

* * * * *